US011781317B2

(12) United States Patent
Meether et al.

(10) Patent No.: US 11,781,317 B2
(45) Date of Patent: Oct. 10, 2023

(54) ROOF STRUCTURE INCLUDING PANELS AND SUBSTRUCTURE FOR SUPPORTING PANELS

(71) Applicant: Leisure Time Products, LLC, Pittsburg, KS (US)

(72) Inventors: Stuart L. Meether, Wichita, KS (US); Daniel R. Whyman, Lamar, MO (US); Timothy A. Goodwin, Frontenac, KS (US); Craig M. Banke, Weir, KS (US); David E. Monohon, Pittsburg, KS (US); Patrick R. Hardy, Carl Junction, MO (US)

(73) Assignee: Leisure Time Products, LLC, Pittsburg, KS (US)

( * ) Notice: Subject to any disclaimer, the term of this patent is extended or adjusted under 35 U.S.C. 154(b) by 98 days.

(21) Appl. No.: 17/477,614

(22) Filed: Sep. 17, 2021

(65) Prior Publication Data

US 2022/0081900 A1 Mar. 17, 2022

Related U.S. Application Data

(60) Provisional application No. 63/079,542, filed on Sep. 17, 2020.

(51) Int. Cl.

| | |
|---|---|
| ***E04B 7/04*** | (2006.01) |
| ***E04B 7/06*** | (2006.01) |
| ***E04H 1/12*** | (2006.01) |
| ***E04B 1/38*** | (2006.01) |

(52) U.S. Cl.
CPC ..... *E04B 7/063* (2013.01); *E04B 1/388* (2023.08); *E04H 1/1205* (2013.01); *E04B 2001/389* (2023.08)

(58) Field of Classification Search
CPC ..... E04B 7/063; E04B 1/40; E04B 1/0046
See application file for complete search history.

(56) References Cited

U.S. PATENT DOCUMENTS

| | | | | | |
|---|---|---|---|---|---|
| 568,066 | A * | 9/1896 | Cook | E04B 7/063 | 52/643 |
| 1,840,041 | A * | 1/1932 | Kellogg | E04D 3/08 | 52/200 |
| 3,333,875 | A * | 8/1967 | Tracy | E04B 7/06 | 52/655.1 |
| 3,423,898 | A * | 1/1969 | Coloney | E04B 7/063 | D25/17 |
| 4,713,923 | A * | 12/1987 | Sielaff | F16B 9/052 | 52/713 |
| 5,380,116 | A * | 1/1995 | Colonias | F16B 9/052 | 403/231 |
| 5,600,924 | A * | 2/1997 | Forsberg | E04B 1/24 | 52/93.2 |
| 6,047,513 | A * | 4/2000 | Gibson | G01N 29/036 | 52/645 |
| 6,772,570 | B2 * | 8/2004 | Horne | E04B 7/06 | 52/715 |

(Continued)

*Primary Examiner* — Basil S Katcheves
(74) *Attorney, Agent, or Firm* — Frost Brown Todd LLP

(57) ABSTRACT

An outdoor building includes a plurality of vertical posts and a roof structure. The roof structure includes a substructure, a pair of side panels, and a pair of end panels. The substructure is coupled with the vertical posts via post brackets. The pair of side panels and the pair of end panels are coupled with the substructure. A method is also provided.

4 Claims, 18 Drawing Sheets

(56) References Cited

U.S. PATENT DOCUMENTS

| | | | | |
|---|---|---|---|---|
| 8,756,895 | B1 * | 6/2014 | Sidhu | E04B 7/022 52/696 |
| 2003/0233805 | A1 * | 12/2003 | Horne | E04C 3/17 52/712 |
| 2016/0069074 | A1 * | 3/2016 | Thomson | E04B 7/026 52/91.1 |

* cited by examiner

ROOF STRUCTURE INCLUDING PANELS AND SUBSTRUCTURE FOR SUPPORTING PANELS

REFERENCE TO RELATED APPLICATION

This application claims priority of U.S. provisional patent application Ser. No. 63/079,542, entitled Roof Structure Including Panels and Substructure for Supporting Panels, filed Sep. 17, 2020, and hereby incorporates this provisional patent application by reference herein in its entirety.

TECHNICAL FIELD

A roof structure for a pergola or other building is provided and includes a plurality of panels. The roof structure includes a substructure for supporting the panels relative to vertical posts.

BACKGROUND

Conventional pergolas or other outdoor buildings are typically assembled on site from a kit of parts. The vertical posts are typically assembled first and then the roof is built "in the air" on top of the vertical posts. Assembling the roof like this can be time consuming, inefficient, and can require at least four people.

BRIEF DESCRIPTION OF THE DRAWINGS

It is believed that certain embodiments will be better understood from the following description taken in conjunction with the accompanying drawings in which.

DETAILED DESCRIPTION

Figure 1:
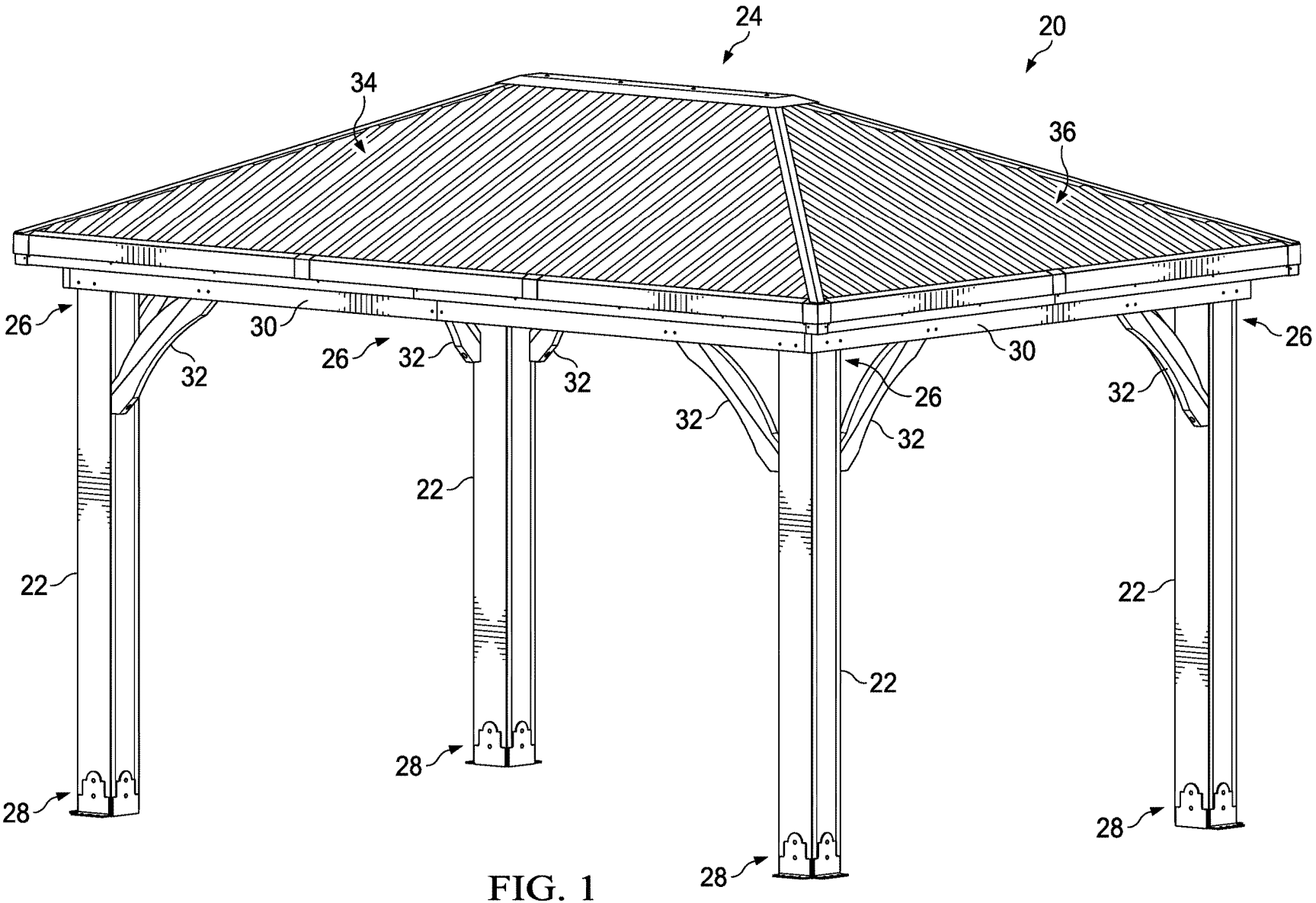
FIG. 1 is an isometric view depicting a pergola having a plurality of vertical posts and a roof structure.

In connection with the views and examples of FIGS. 1-19, wherein like numbers indicate the same or corresponding elements throughout the views, FIG. 1 illustrates a pergola 20 that comprises a plurality of vertical posts 22 and a roof structure 24 that is supported, at least in part, by the vertical posts 22. Each of the vertical posts 22 can have an upper end 26 that supports the roof structure 24 and a lower end 28 that can be installed on a ground surface (e.g., a concrete pad). The pergola 20 can include a plurality of lateral supports 30 and a plurality of corbels 32. Each lateral support 30 can extend between and can be coupled with respective pairs of the vertical posts 22. Each corbel 32 can be coupled with respective ones of the upper ends 26 and the lateral supports 30. In one embodiment, the vertical posts 22, the lateral supports 30, and the corbels 32 can be formed of wood, but in other embodiments, can be formed of any of a variety of suitable alternative materials, such as, for example, a wood and thermoplastic composite material. It is to be appreciated that, although a pergola is shown and described herein, other buildings are contemplated, such as, for example, a gazebo or a pole building.

Figure 2:
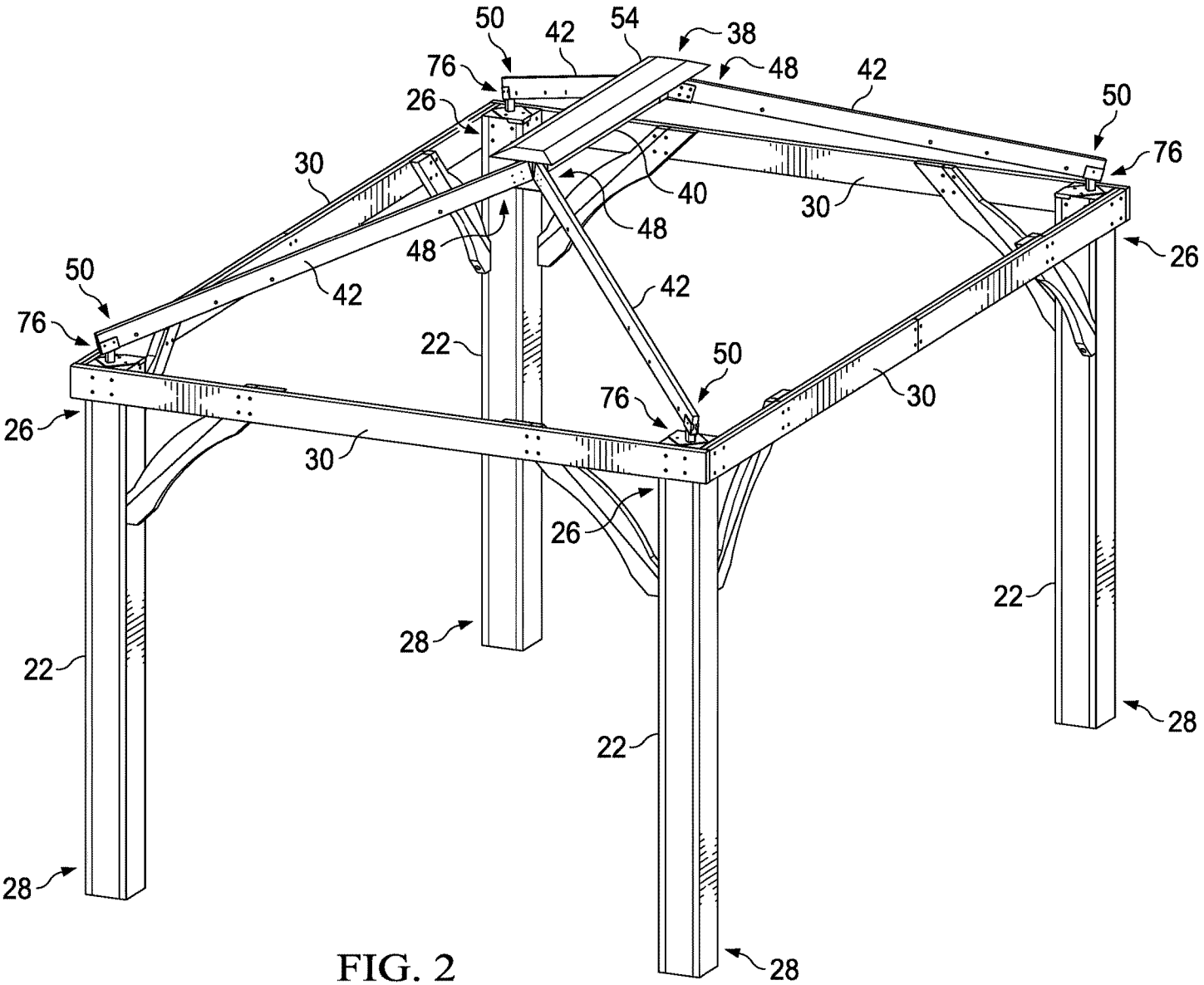
FIG. 2 is an isometric view of the plurality of vertical posts and a substructure of the roof structure of FIG. 1.
Figure 3:
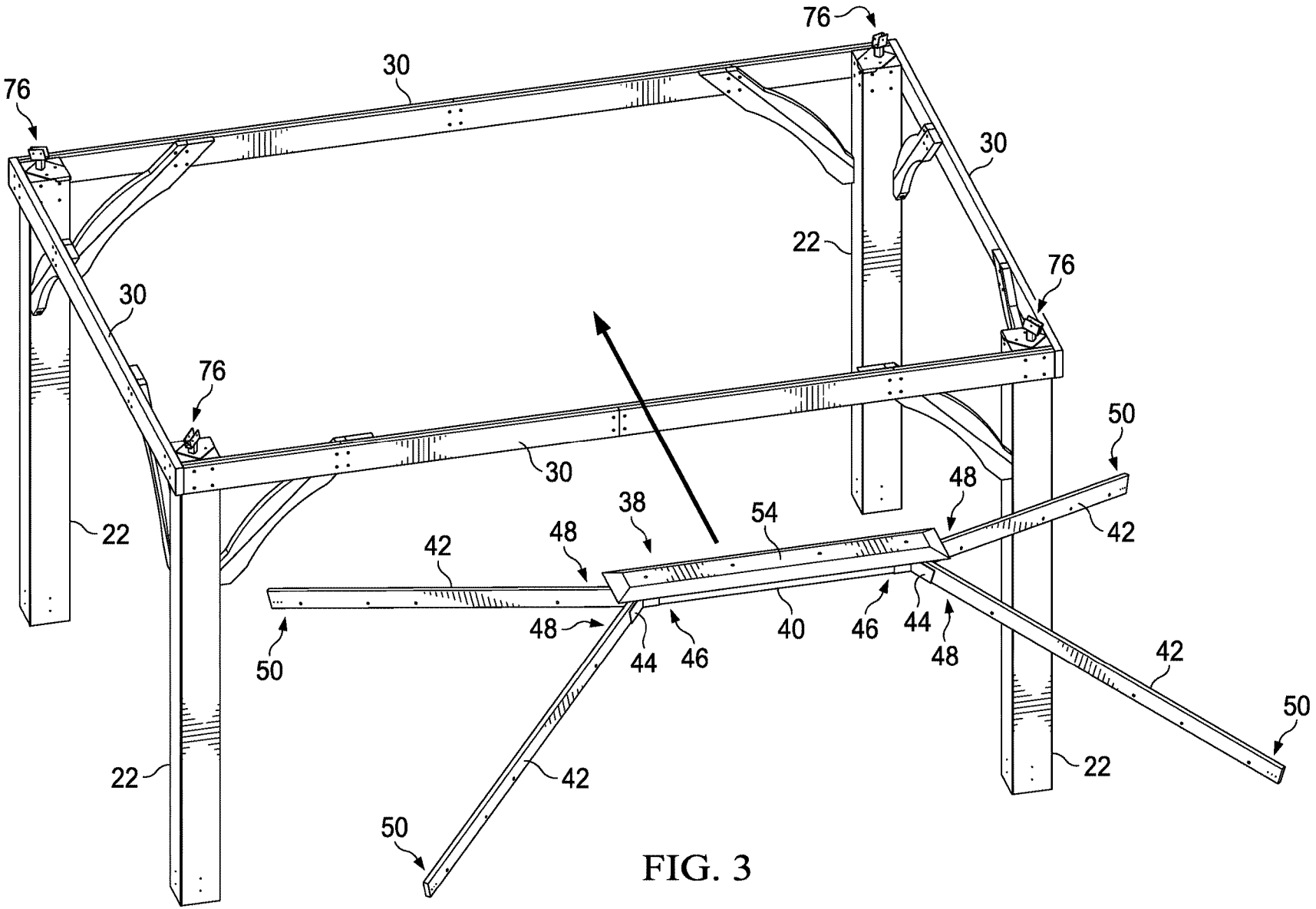
FIG. 3 is a partially exploded view of the plurality of vertical posts and the substructure of FIG. 2.
Figure 4:
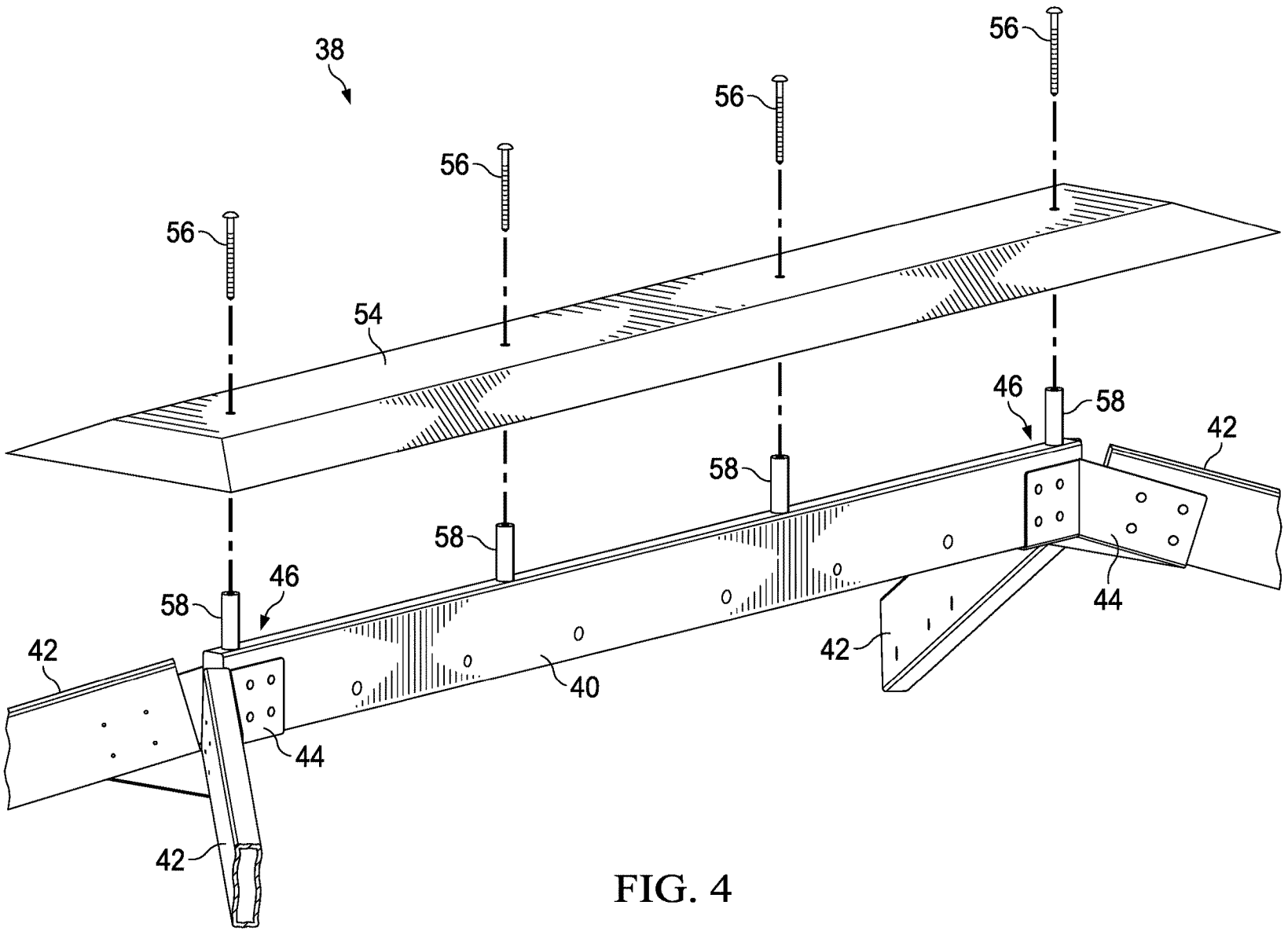
FIG. 4 is an enlarged side isometric, partially exploded view of the substructure of FIG. 2.

The roof structure 24 can include a pair of side panels 34 (one shown in FIG. 1) and a pair of end panels 36 (one shown in FIG. 1). Referring now to FIGS. 2-4, the roof structure 24 can also include a substructure 38 that facilitates support of the side panels 34 and the end panels 36 with respect to the vertical posts 22. As will be described in further detail below, the substructure 38 can facilitate assembly of the roof structure 24 more efficiently than conventional pergola arrangements. The substructure 38 can include a main support beam 40, a plurality of lateral beams 42, and a pair of brackets 44. Each of the brackets 44 can be coupled with an opposing end 46 of the main support beam 40 (e.g., with fasteners). Each lateral beam 42 can include a proximal end 48 and a distal end 50. The proximal ends 48 of the lateral beams 42 can be coupled to one of the brackets 44 (e.g. with fasteners) such that the lateral beams 42 extend outwardly from the main support beam 40. A ridge cap 54 can overlie the main support beam 40 and can be coupled thereto by a plurality of fasteners 56 and a plurality of spacers 58 that are interposed between the ridge cap 54 and the main support beam 40. In one embodiment, the main support beam 40 and the lateral beams 42 can be formed of wood, but in other embodiments, can be formed of any of a variety of suitable alternative materials, such as, for example, a wood and thermoplastic composite material.

Figure 5:
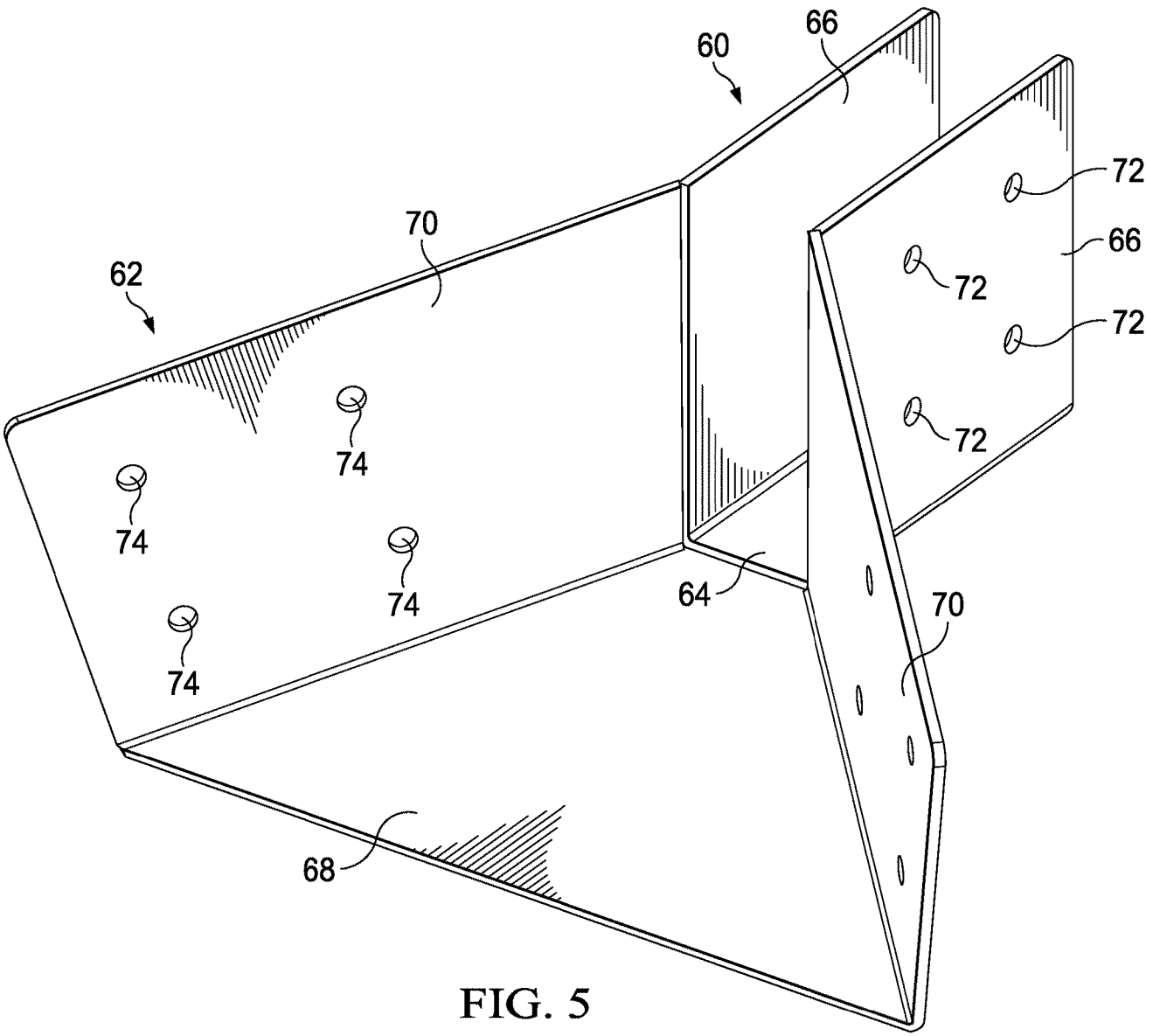
FIG. 5 is an isometric view of a bracket of the substructure of FIG. 2.

In one embodiment, the brackets 44 can be substantially identical with one another such that the brackets 44 can be used interchangeably. Referring now to FIG. 5, one of the brackets 44 is illustrated as a representative example of each of the brackets 44 illustrated in FIGS. 2-4. The bracket 44 can include a main support portion 60 and a lateral support portion 62 that are coupled together and are configured for attachment to the main support beam 40 and the lateral beams 42, respectively. The main support portion 60 can include a lower flange 64 and a pair of side flanges 66 that are parallel to each other, spaced from each other, and extend substantially orthogonally from the lower flange 64 such that the main support portion 60 is substantially u-shaped. The lateral support portion 62 can include a lower flange 68 and a pair of side flanges 70 that are spaced from each other and extend substantially orthogonally from the lower flange 68. The lower flange 68 can extend from, and can be angled downwardly with respect to, the lower flange 64. Each of the side flanges 70 can extend from, and can be angled outwardly with respect to, respective ones of the side flanges 66. In one embodiment, the lower flange 68 can be angled with respect to the lower flange 64 by between about 10 degrees and 20 degrees and the side flanges 70 can be angled outwardly with respect to the respective ones of the side flanges 66 by between about 20 degrees and 30 degrees. One of the side flanges 66 and each of the side flanges 70 can define a respective plurality of apertures 72, 74 to accommodate fasteners. In one embodiment, the brackets 44 can be formed of a metal, such as steel, a steel alloy, or an aluminum alloy.

Figure 6:
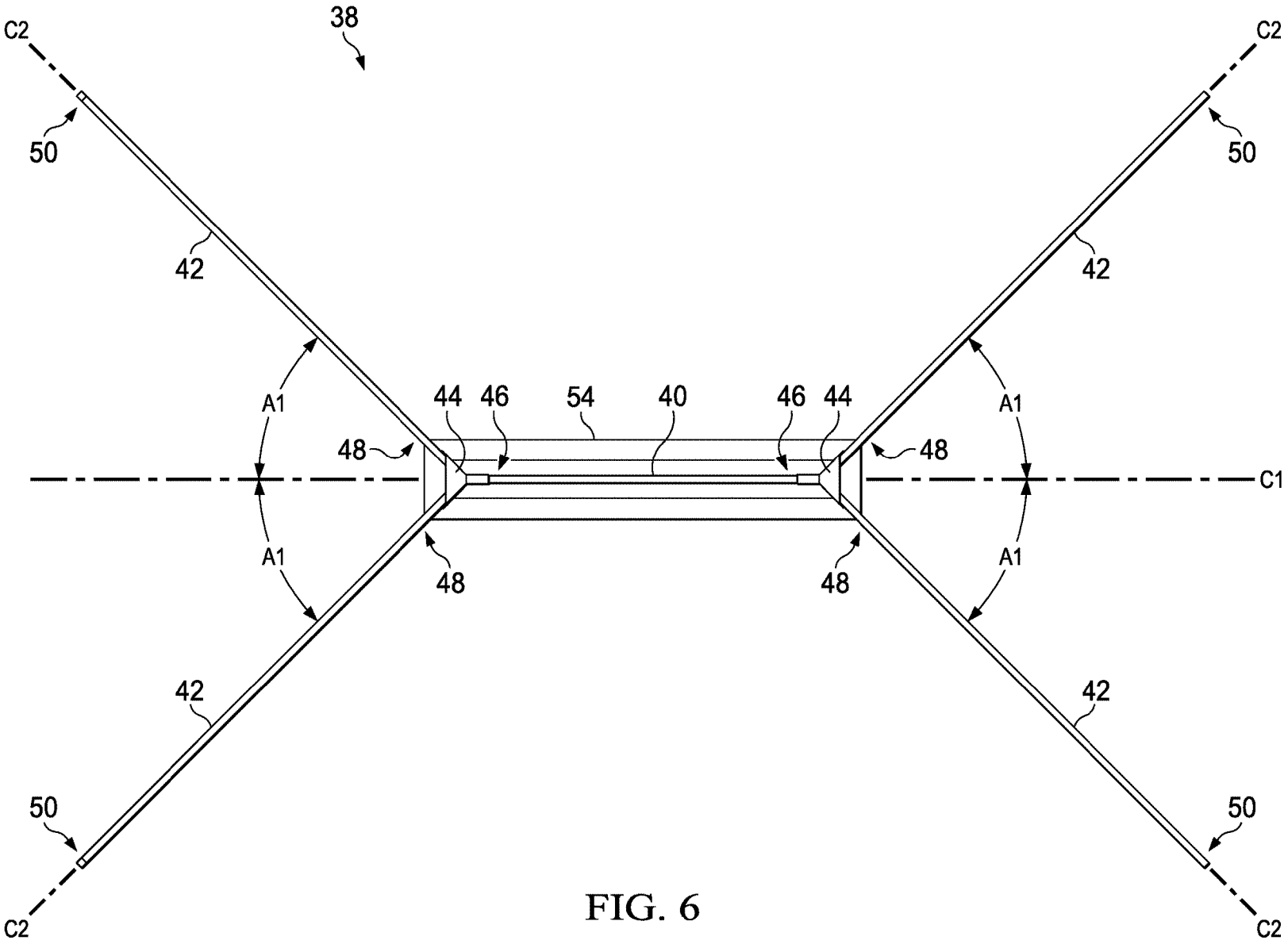
FIG. 6 is an upper elevation view of the substructure of FIG. 2.
Figure 7:
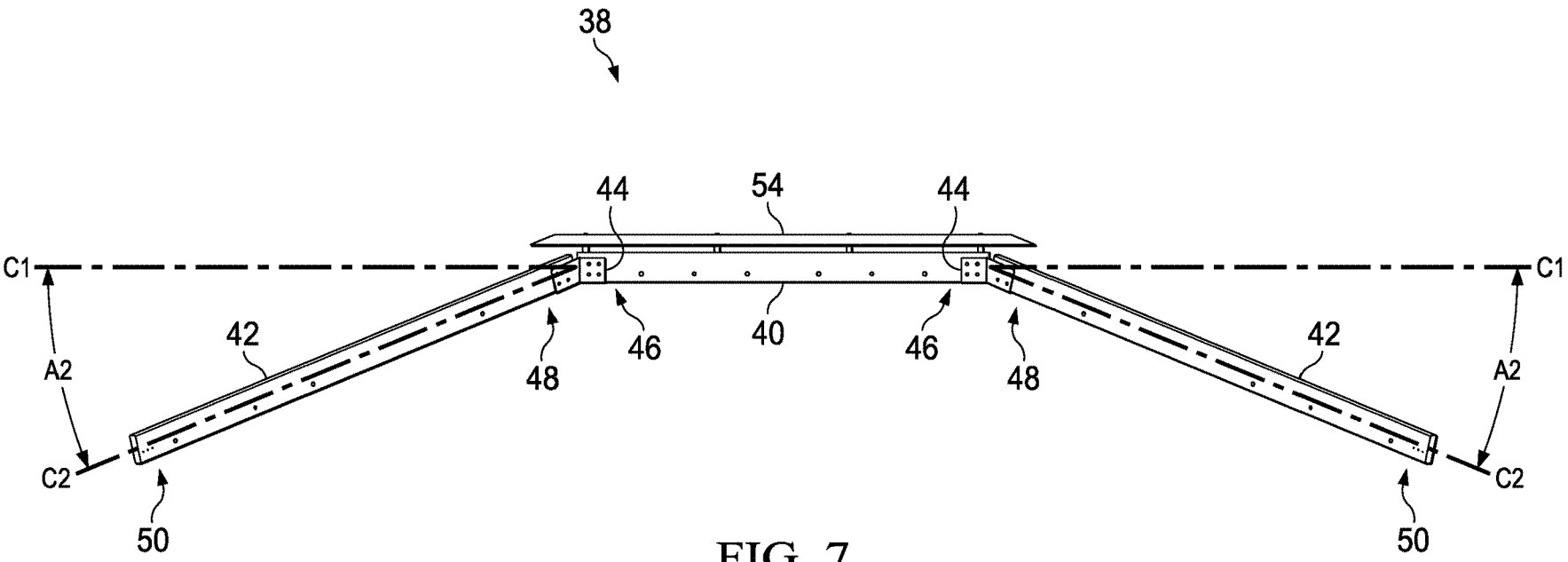
FIG. 7 is a side elevation view of the substructure of FIG. 2.

Referring now to FIGS. 6 and 7, the main support beam 40 of the substructure 38 can define a longitudinal centerline C1 that is substantially horizontal (e.g., parallel with a ground surface). Each lateral beam 42 can define longitudinal centerlines C2. As illustrated in FIG. 6, each lateral beam 42 can extend outwardly from the main support beam 40 at a horizontal angle A1 (e.g., as measured between the longitudinal centerlines C1, C2) such that respective pairs of that lateral beams 42 attached at each opposing end 46 of the main support beam 40 have a substantially v-shaped arrangement. The horizontal angle A1 can be defined by a relative angle between the side flanges 66 and respective ones of the side flanges 70 of the bracket 44 (illustrated in FIG. 5). As illustrated in FIG. 7, each lateral beam 42 can extend downwardly from the main support beam 40 at a vertical angle A2 (e.g., as measured between the longitudinal centerlines C1, C2). The horizontal angle A2 can be defined by a relative angle between the lower flanges 64, 68 of the bracket 44 (illustrated in FIG. 5). The vertical angle A2 can define the overall pitch of the side and end panels 34, 36. In one embodiment, the horizontal angle A1 can be between about 30 degrees and about 50 degrees, and specifically about 40 degrees, and the vertical angle A2 can be between about 10 degrees and about 30 degrees, and specifically about 20 degrees. It is to be appreciated that the lateral beams 42 can extend outwardly from the main support beam 40 at any of a variety of suitable horizontal angles which can be a function of the length and width of the pergola 20. It is also to be appreciated that the lateral beams 42 can extend downwardly from the main support beam 40 at any of a variety of suitable vertical angles which can be a function of the overall height of the roof structure 24.

Figure 8:
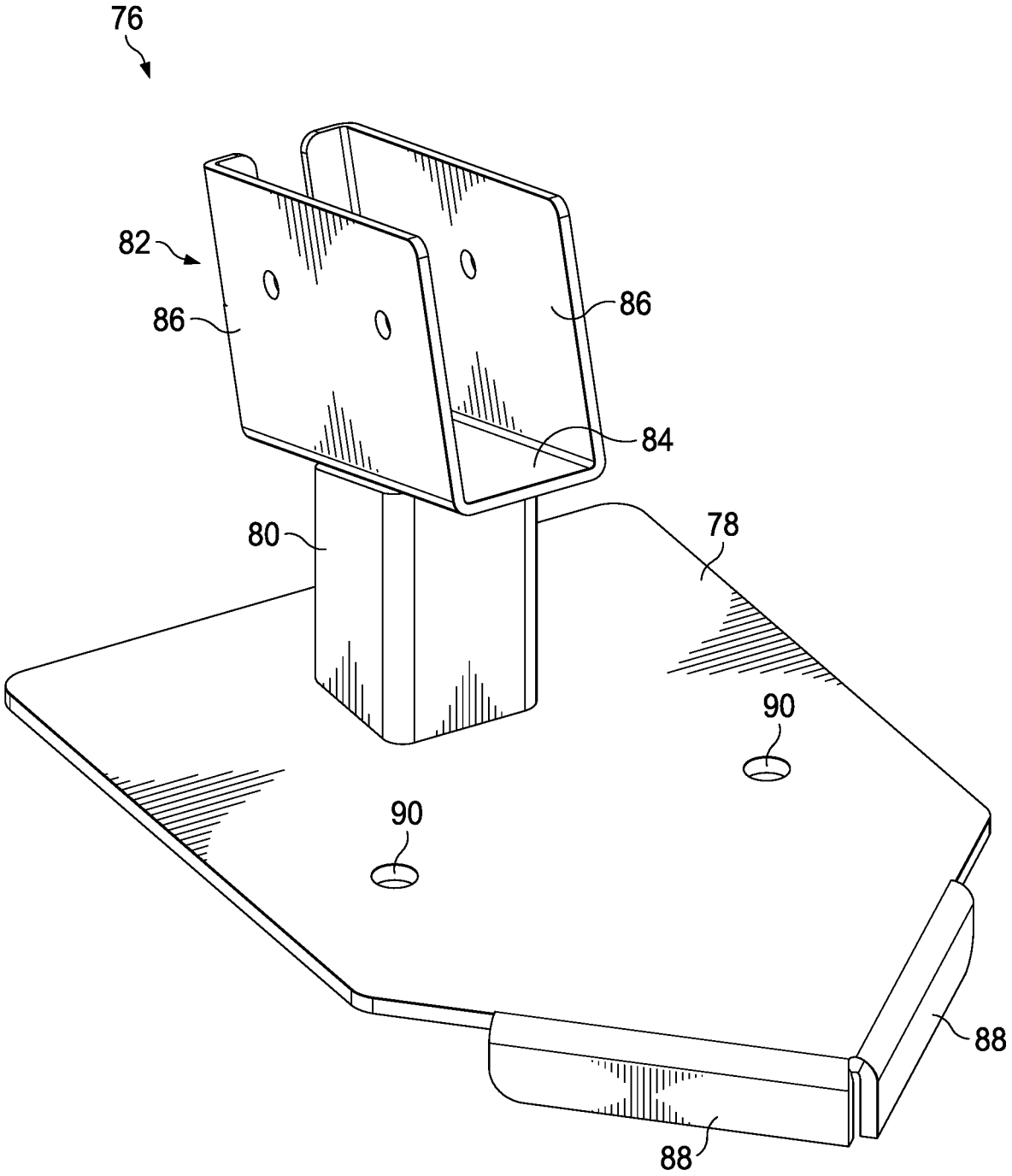
FIG. 8 is a front isometric view of a post bracket of the pergola of FIG. 1.
Figure 9:
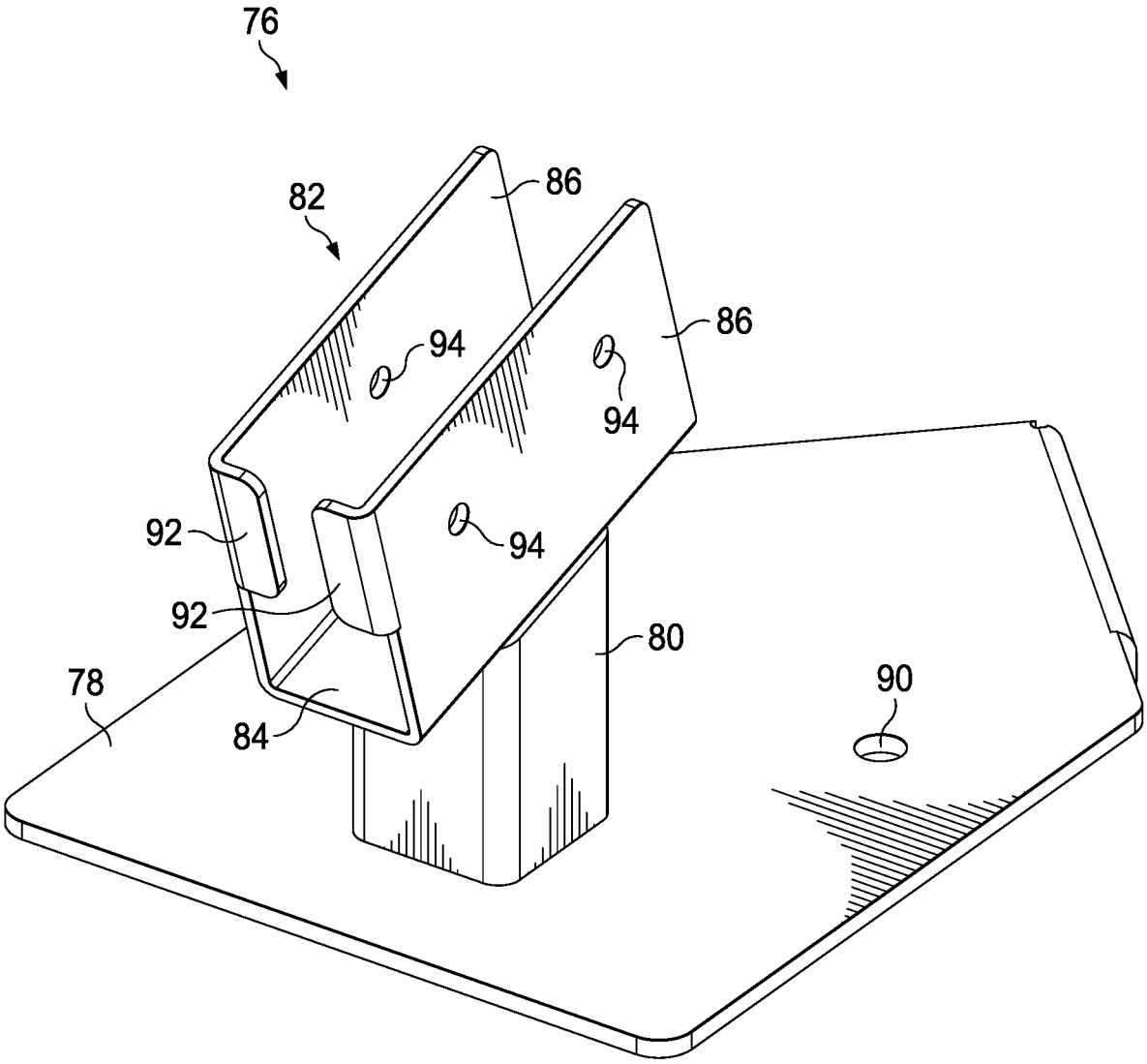
FIG. 9 is a rear isometric view of the post bracket of FIG. 8.

Referring again to FIGS. 2 and 3, the roof structure 24 can include a plurality of post brackets 76 that facilitate coupling of the lateral beams 42 to the vertical posts 22. Each post bracket 76 can be coupled with one of the vertical posts 22 and the distal ends 50 of the lateral beams 42 can be coupled to the vertical posts 22. The post brackets 76 can be substantially identical with one another such that the post brackets 76 can be used interchangeably. Referring now to FIGS. 8 and 9, one of the post brackets 76 is illustrated as a representative example of each of the post brackets 76 illustrated in FIGS. 2 and 3. The post bracket 76 can include a base 78, a post 80 extending from the base 78, and a cradle 82 coupled with the post 80. In one embodiment, the post brackets 76 can be formed of a metal, such as steel, a steel alloy, or an aluminum alloy. The cradle 82 can include a lower flange 84 and a pair of side flanges 86 that are parallel to each other, spaced from each other, and extend substantially orthogonally from the lower flange 84 such that the cradle 82 is substantially u-shaped. The lower flange 84 can be angled with respect to the base by an angle that is substantially the same as the vertical angle described above.

As illustrated in FIG. 8, a pair of base flanges 88 can extend from the base 78 such that the base flanges 88 are disposed on an opposite side of the base 78 as the post 80 and the cradle 82. The base flanges 88 can be arranged in a v-shape and can facilitate alignment of the post bracket 76 on the vertical post 22. For example, when the post bracket 76 is being installed on the vertical post 22, the base flanges 88 can interface with a corner of the vertical post 22 to properly align the post bracket 76 on the vertical post 22. The base 78 can define a pair of apertures 90 that accommodate fasteners (not shown) and are strategically located to alleviate splitting of the vertical post 22 when the fasteners are provided therethrough.

As illustrated in FIG. 9, the cradle 82 can include a pair of retention tabs 92 that each extend orthogonally from respective ones of the side flanges 86 and towards each other. When one of the distal ends 50 of the lateral beams 42 is provided in the cradle 82, the retention tabs 92 can help position the distal end 50 properly in the cradle 82 and can prevent the distal end 50 from sliding through the end of the cradle 82. Each of the side flanges 86 can define at least one aperture 94 that can accommodate fasteners (not shown). The aperture(s) 94 located on one of the side flanges 86 can be horizontally offset from the aperture(s) located on the other of the side flanges 86 to prevent the fasteners on either side of the cradle 82 from inadvertently contacting one another.

Figure 10:
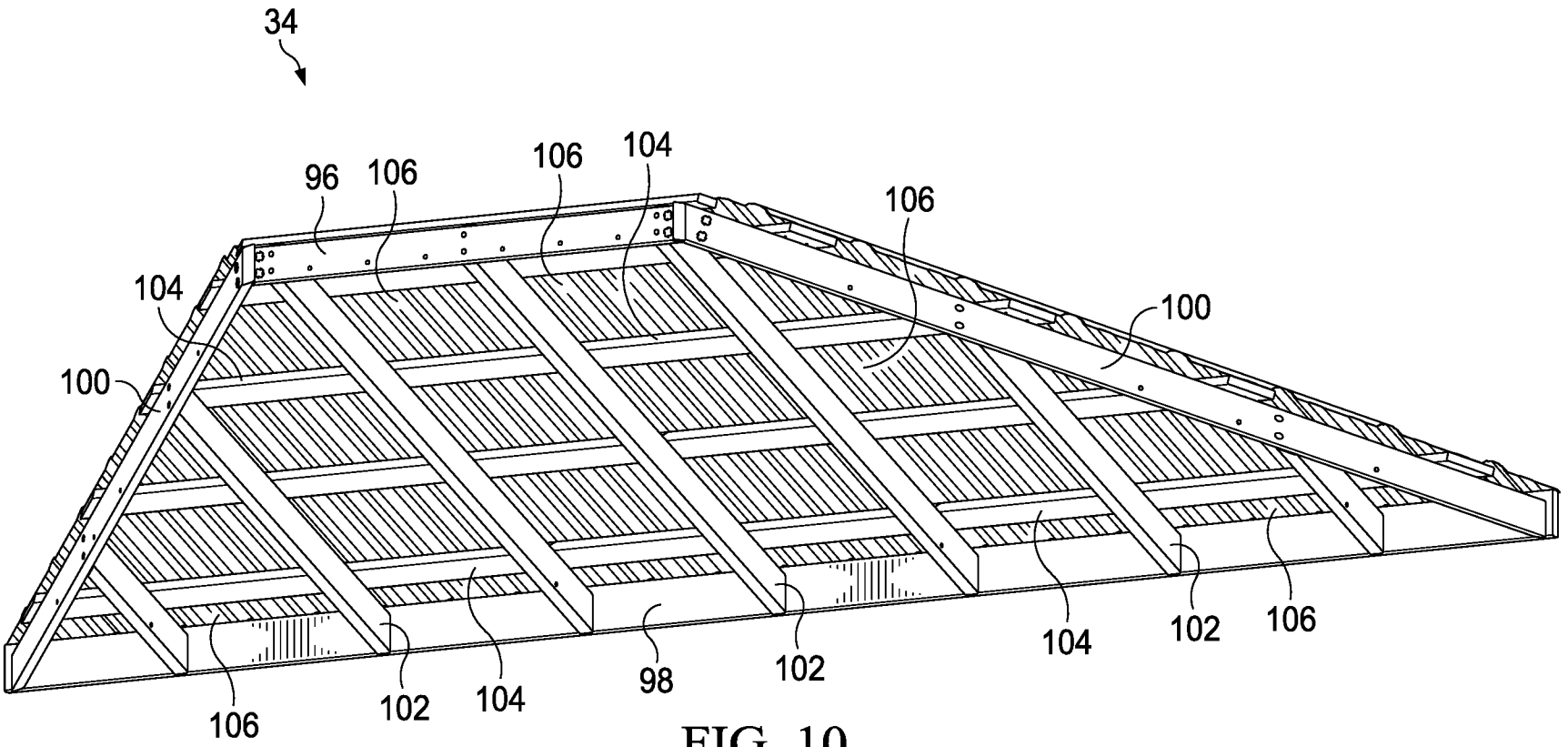
FIG. 10 is a lower isometric view of a side panel of the pergola of FIG. 1.

Referring now to FIG. 10, one of the side panels 34 is illustrated as a representative example of each of the side panels 34 illustrated in FIG. 1. The side panel 34 can include a front rim joist 96, a rear rim joist 98, and a pair of side rim joists 100 that extend between the front rim joist 96 and the rear rim joist 98 at an angle such that the side panel 34 is substantially trapezoid-shaped. The side panel 34 can include a plurality of rafters 102 that are substantially parallel to each other and spaced from each other. Each of the rafters 102 can be coupled at one end to the rear rim joist 98 (e.g., with fasteners) and at another end to either the front rim joist 96 or the side rim joists 100, depending on the position of the rafter 102. Each of the rafters 102 can be substantially perpendicular to the rear rim joist 98.

Figure 11:
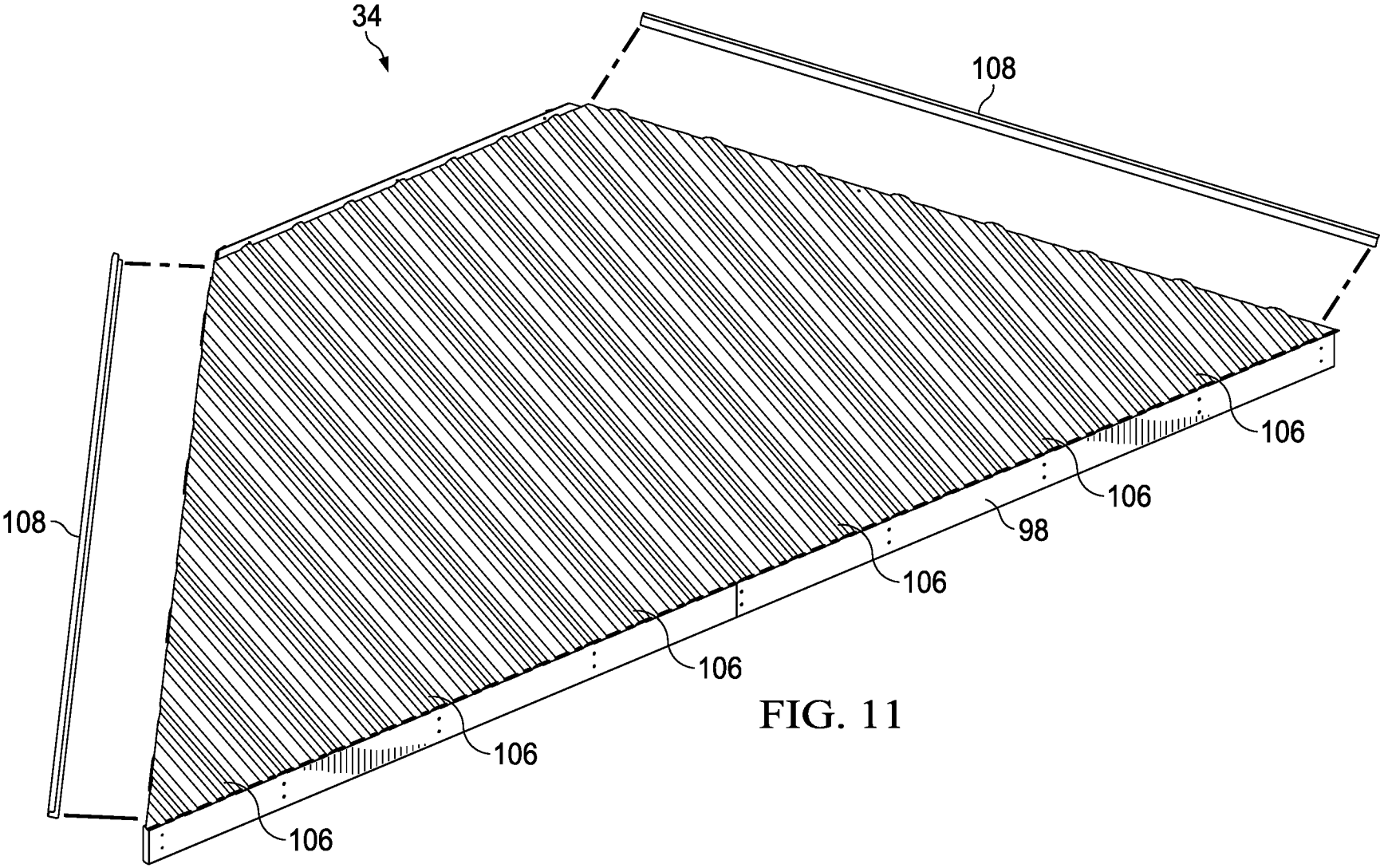
FIG. 11 is an upper isometric view of the side panel of FIG. 10 in association with a pair of ridge cap channels.

A plurality of purlins 104 can overlie the rafters 102 and can be substantially perpendicular to the rafters 102. A plurality of cover panels 106 can overlie the rafters 102 and the purlins 104 and can be secured thereto by a plurality of fasteners (not shown). Each of the cover panels 106 can overlie adjacent ones of the cover panels 106 such that the cover panels 106 cooperate to prevent precipitation from reaching an area beneath the side panel 34. In one embodiment, the front, rear, and side rim joists 96, 98, 100, the rafters 102, and the purlins 104 can be formed of wood, but in other embodiments, can be formed of any of a variety of suitable alternative materials, such as, for example, a wood and thermoplastic composite material. As illustrated in FIG. 11, a pair of ridge cap channels 108 can be coupled with the side panel 34 on opposite sides (e.g., with fasteners) such that each ridge cap channel 108 is substantially parallel with one of the side rim joists 100. The ridge cap channels 108 can be substantially j-shaped.

Figure 12:
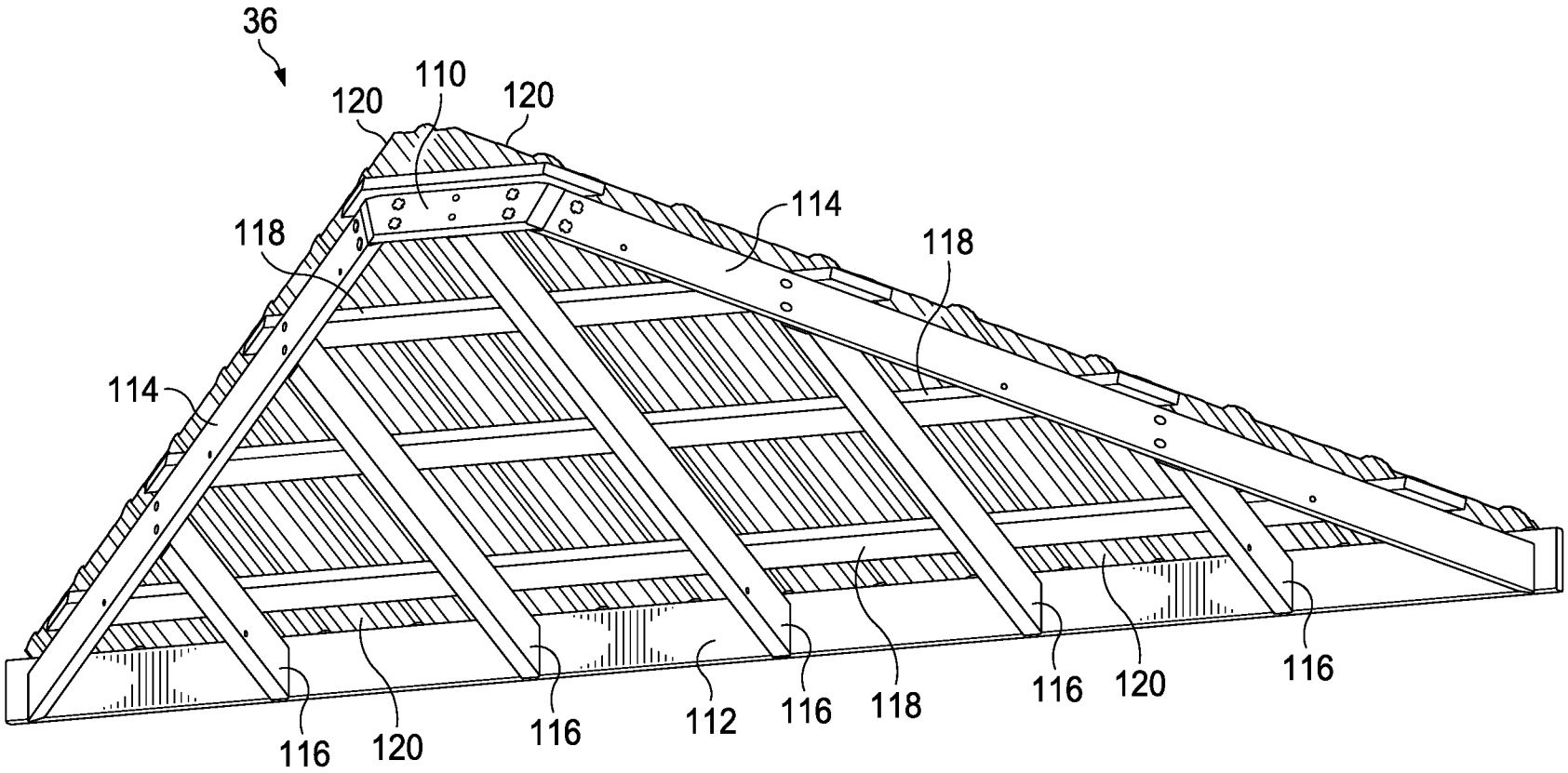
FIG. 12 is a lower isometric view of an end panel of the pergola of FIG. 1.
Figure 13:
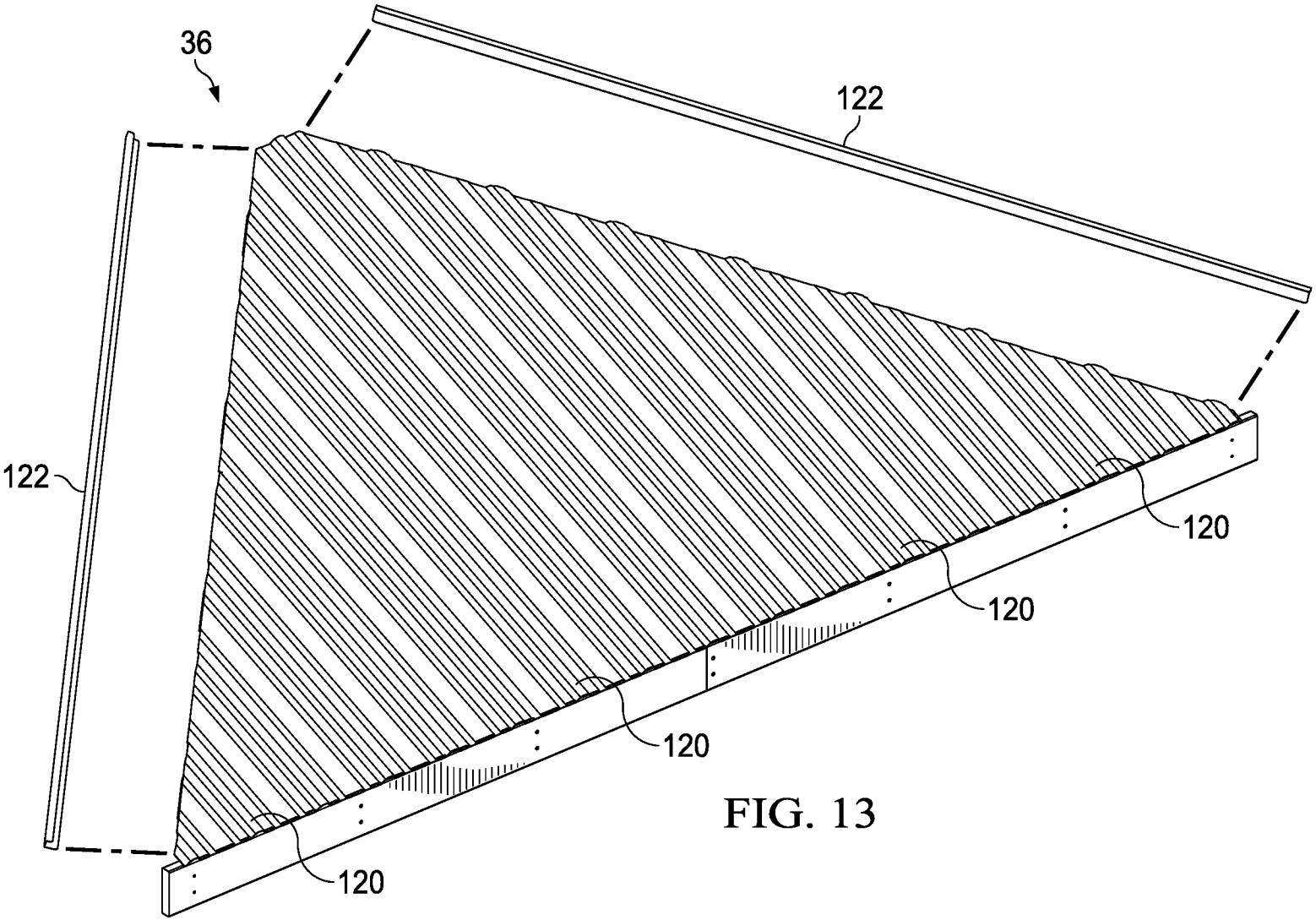
FIG. 13 is an upper isometric view of the end panel of FIG. 12 in association with a pair of ridge cap channels.

Referring now to FIG. 12, one of the end panels 36 is illustrated as a representative example of each of the end panels 36 illustrated in FIG. 1. The end panel 36 can be similar to, or the same in many respects as, the side panel 34 illustrated in FIG. 10. For example, the end panel 36 can include a front rim joist 110, a rear rim joist 112, a pair of side rim joists 114, a plurality of rafters 116, a plurality of purlins 118, and a plurality of cover panels 120. As illustrated in FIG. 13, a pair of ridge cap channels 122 can be coupled to opposite sides of the end panel 36 (e.g., with fasteners).

One example of a method for assembling the pergola 20 will now be described. First, the vertical posts 22 and the lateral supports 30 can be assembled together to effectively provide an upright structure that is ready to receive the roof structure 24. The post brackets 76 can be positioned on top of each vertical post 22 such that the base flanges 88 extend over an innermost corner of the vertical post 22 (e.g., the corner of the vertical post 22 that is most proximate to the rest of the vertical posts 22) and attached thereto with fasteners.

The side panels 34, the end panels 36, and the substructure 38 of the roof structure 24 can then be assembled apart from the upright structure (e.g., on the ground or on a plurality of sawhorses). To assemble the side panels 34, first, the front, rear, and side rim joists 96, 98, 100 are attached together. Each of the rafters 102 can then be attached to the rear rim joist 98 and either the front rim joist 96 or the side rim joist 100 (depending on the location of the rafter 102). The purlins 104 can be attached to the rafters 102 and the cover panels 106 can be attached over the purlins 104. Finally, the ridge cap channels 108 can be attached adjacent to the side rim joists 100. The end panels 36 can be constructed in a similar manner.

To assemble the substructure 38, first, each of the opposing ends 46 of the main support beam 40 are attached to the main support portion 60 of one of the brackets 44 (e.g., with fasteners). The proximal ends 48 of two of the lateral beams 42 can then be attached to the lateral support portions 62 of each of the brackets 44 (e.g., with fasteners). Finally, the ridge cap 54 can be attached over the main support beam 40 with the fasteners 56 and the spacers 58.

Figure 14:
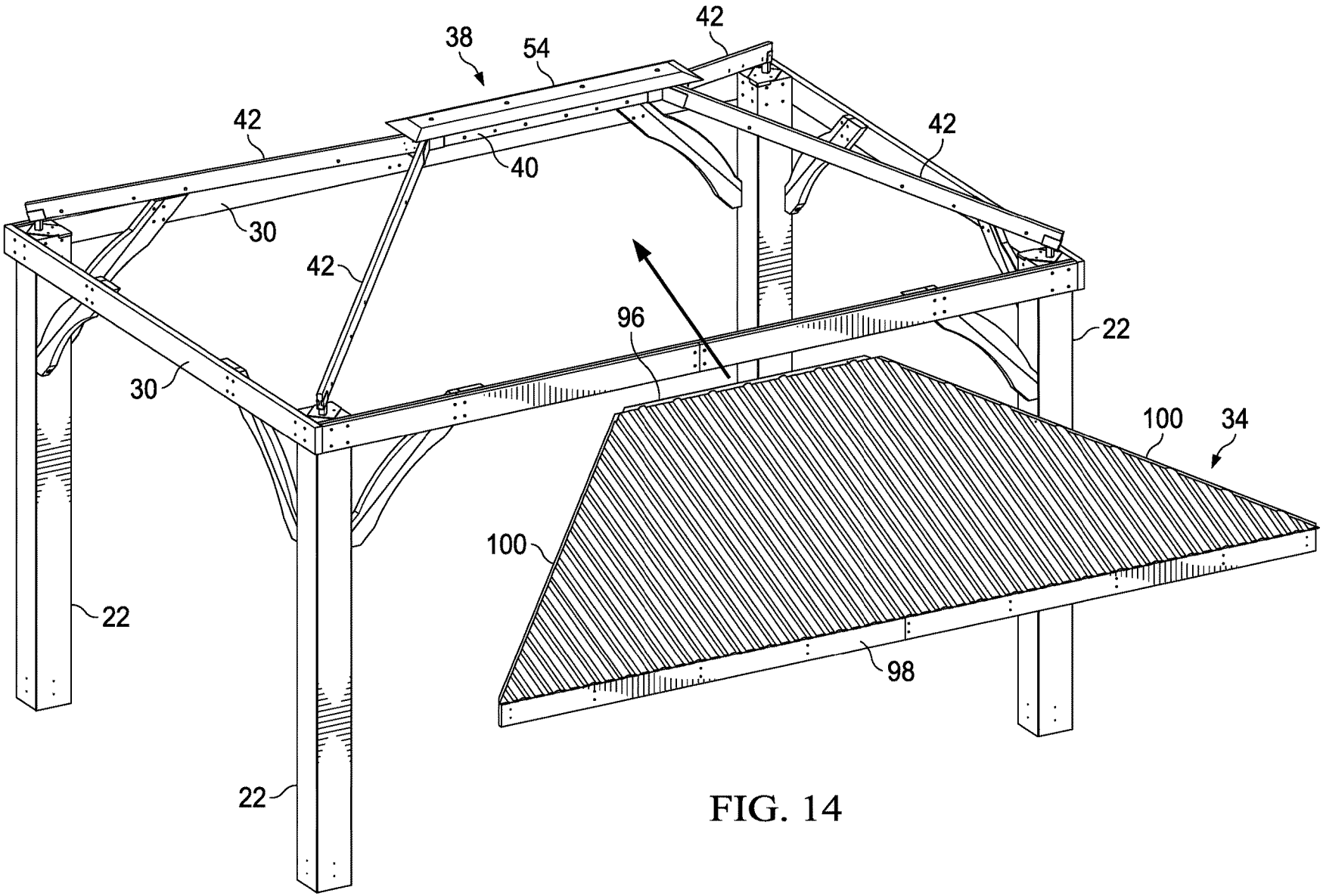
FIG. 14 is an upper isometric, partially exploded, view depicting installation of the side panel of FIG. 10 onto the vertical posts and the substructure of FIG. 2.
Figure 15:
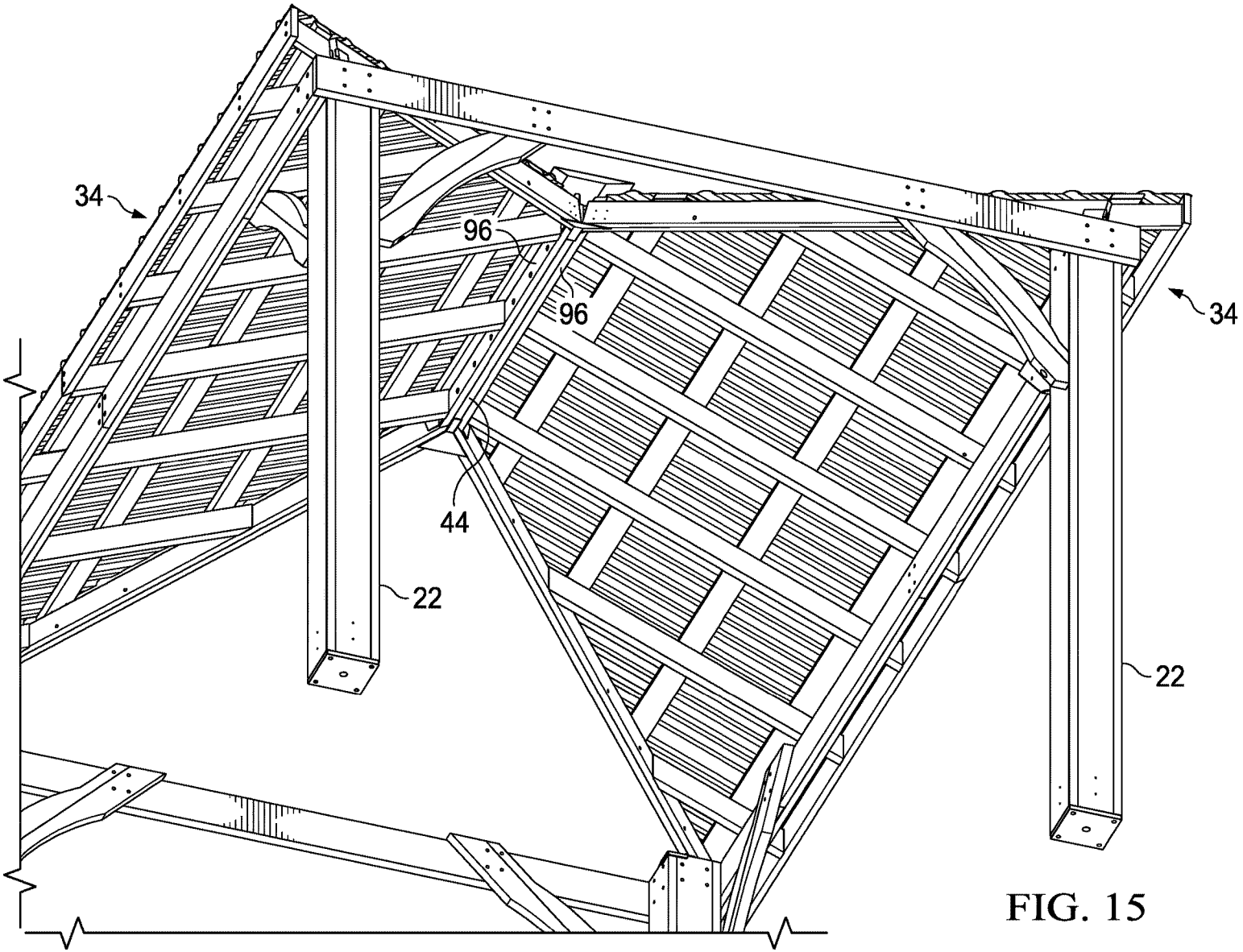
FIG. 15 is a lower isometric view depicting a pair of side panels installed onto the vertical posts and the substructure of FIG. 14.

Once the assembly of the substructure 38 is completed (see FIGS. 6 and 7), it can be lifted over the upright structure (e.g., the vertical posts 22 and the lateral supports 30) and each of the distal ends 50 of the lateral beams 42 can be inserted into respective ones of the cradles 82 of the post brackets 76, and attached thereto with fasteners. As illustrated in FIG. 14, one of the side panels 34 can be slid into place such that the front rim joist 96 interfaces with the main support beam 40, the side rim joists 100 interface with the lateral beams 42, and the ridge cap 54 overlies a portion of the side panel 34. The front rim joist 96 can then be attached to the main support beam 40 with fasteners. The other of the side panels 34 can then be installed in a similar manner on the other side of the substructure 38 such that the main support beam 40 is sandwiched between the front rim joists 96, as illustrated in FIG. 15. The side panels 34 can accordingly be attached directly to the main support beam 40 and the lateral beams 42 such that the side panels 34 are supported by the brackets 44 and the post brackets 76 without requiring direct attachment thereto.

Figure 16:
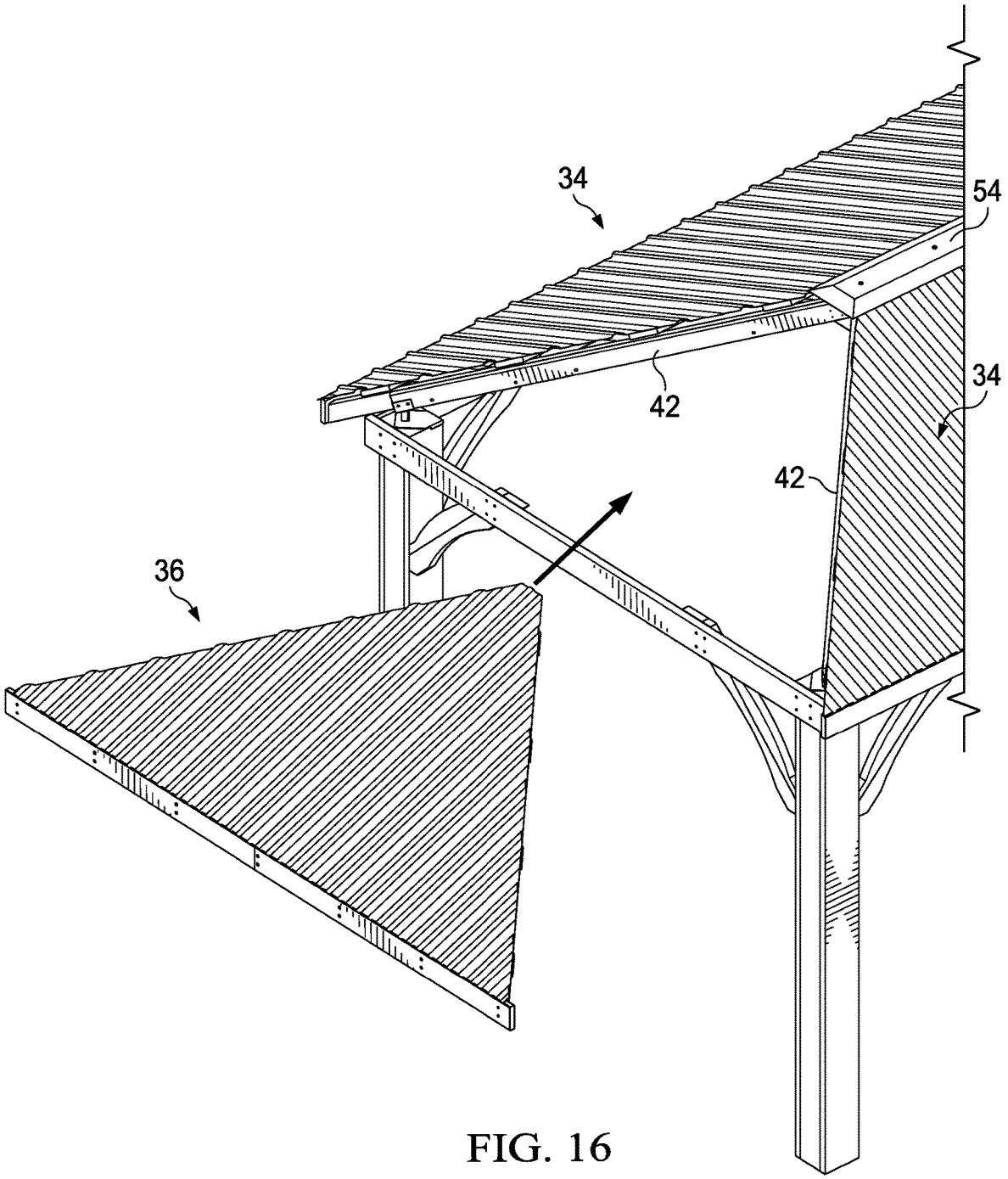
FIG. 16 is an upper isometric, partially exploded, view depicting installation of the end panel of FIG. 12 onto the arrangement of FIG. 15.
Figure 17:
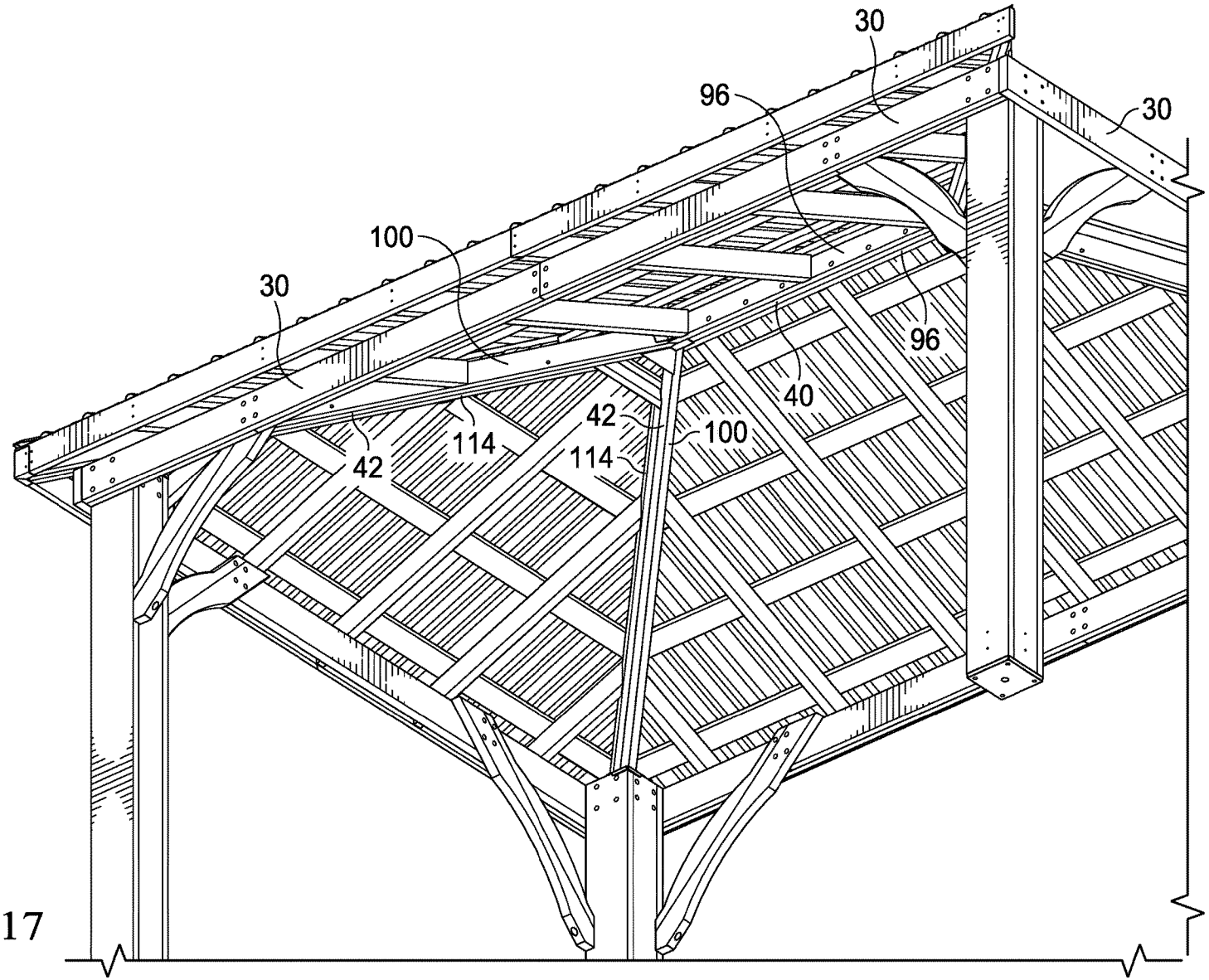
FIG. 17 is a lower isometric view depicting the end panel installed onto the arrangement of FIG. 16.

As illustrated in FIG. 16, one of the end panels 36 can be slid into place such that the side rim joists 114 interface with the lateral beams 42, and the ridge cap 54 overlies a portion of the end panel 36. Each side rim joist 114 can then be attached to one of the lateral beams 42 and one of the side rim joists 100 with fasteners such that each lateral beam 42 is sandwiched between one of the side rim joists 100 of the side panel 34 and one of the side rim joists 114 of the end panel 36, as illustrated in FIG. 17. The other of the end panels 36 can then be installed in a similar manner on the other end of the substructure 38. The end panels 36 can accordingly be attached directly to the main support beam 40 and the lateral beams 42 such that end panels 36 are supported by the brackets 44 and the post brackets 76 without requiring direct attachment thereto.

Figure 18:
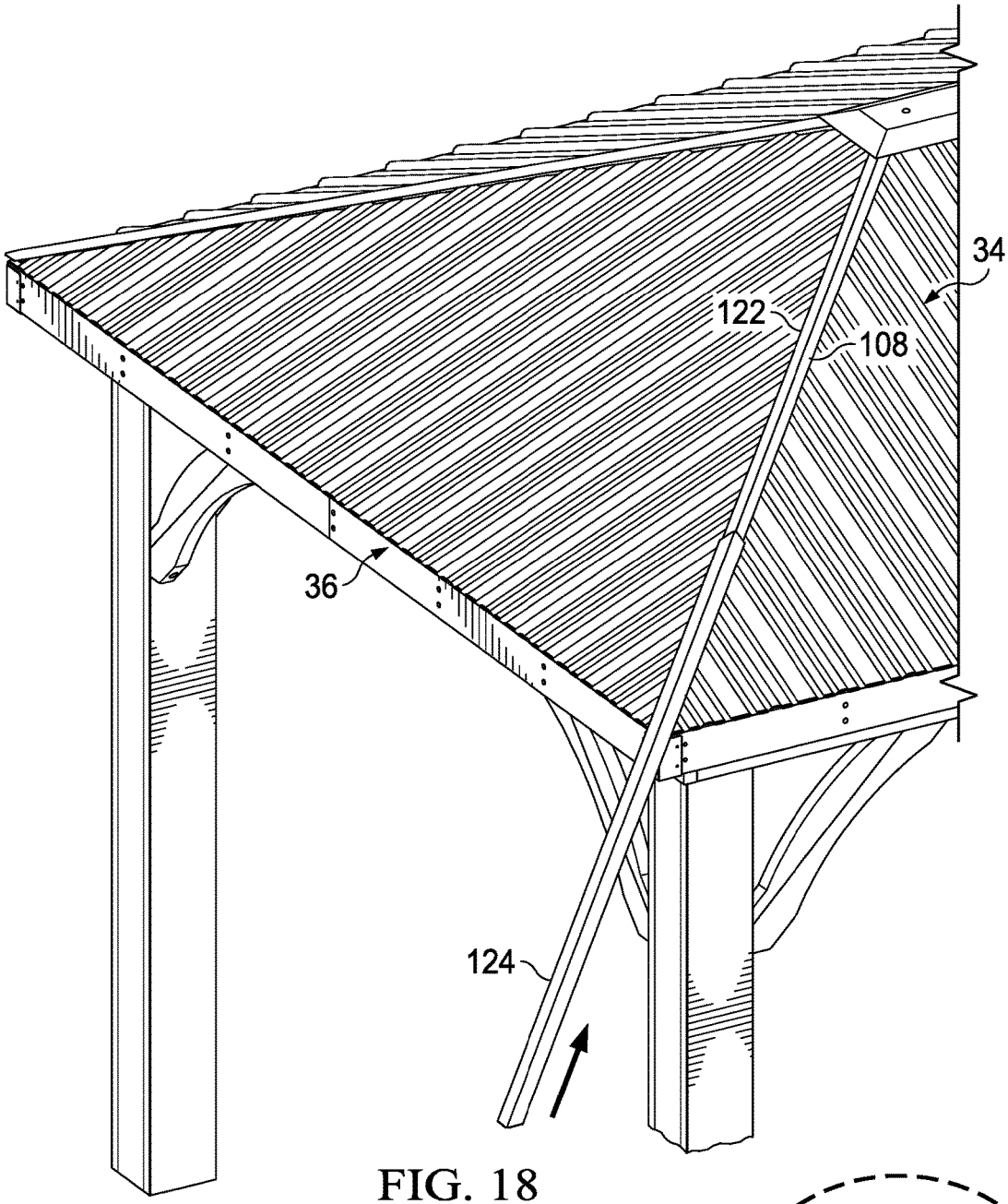
FIG. 18 is an upper isometric view depicting installation of a corner ridge cap onto the arrangement of FIG. 17.
Figure 19:
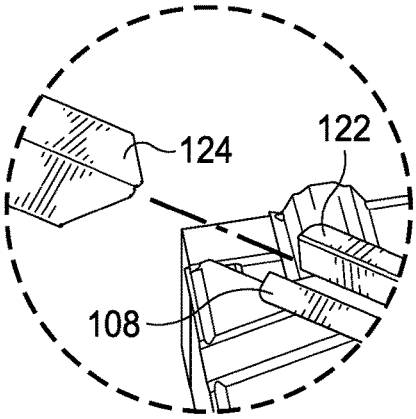
FIG. 19 is an enlarged view of the installation of the corner ridge cap onto the arrangement of FIG. 17.

As illustrated in FIGS. 18 and 19, a corner ridge cap 124 can be slid over the ridge cap channels 108, 122 of adjacent ones of the side panel 34 and the end panel 36. Other corner ridge caps (not shown) can be installed over the ridge cap channels 108, 122 of other adjacent ones of the side panel 34 and the end panel 36.

By assembling each of the side panels 34, the end panels 36, and the substructure 38 apart from the upright structure, and then installing each of the side panels 34, the end panels 36, and the substructure 38 individually on the upright structure, assembly of the roof structure 24 can be performed by only two people and thus can be more efficient and less cumbersome than conventional roof structures which are oftentimes stick built on the upright structure and can require four or more people to complete. The roof structure 24 can also be stronger and more durable than these conventional arrangements. In addition, the side panels 34 and end panels 36 can be secured to the substructure 38 from underneath the roof structure 24 thereby alleviating the need to climb onto the top of the roof structure 24 to complete assembly.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A substructure for a building, the substructure comprising:

a main support beam including opposing ends and defining a centerline;

a first bracket attached to one of the opposing ends of the main support beam, the first bracket comprising:

a first main support portion comprising a first lower main flange and a first pair of main side flanges; and a first lateral support portion coupled with the first main support portion and comprising a first lower lateral flange and a first pair of lateral side flanges;

a second bracket attached to another one of the opposing ends of the main support beam, the second bracket comprising:

a second main support portion comprising a second lower main flange and a second pair of main side flanges; and a second lateral support portion coupled with the second main support portion and comprising a second lower lateral flange and a second pair of lateral side flanges;

a first pair of lateral beams attached to the first bracket, each lateral beam of the first pair of lateral beams being horizontally angled from the centerline by a first horizontal angle and being angled vertically from the centerline by a first vertical angle; and a second pair of lateral beams attached to the second bracket, each lateral beam of the second pair of lateral beams being horizontally angled from the centerline by a second horizontal angle and being angled vertically from the centerline by a second vertical angle, wherein:

each main side flange of the first pair of main side flanges is parallel to one another, is spaced from one another, and extends substantially orthogonally from the first lower main flange;

each lateral side flange of the first pair of lateral side flanges is spaced from one another and extends substantially orthogonally from the first lower lateral flange;

the first lower lateral flange extends continuously between the first pair of lateral side flanges;

each main side flange of the second pair of main side flanges is parallel to one another, is spaced from one another, and extends substantially orthogonally from the second lower main flange;

each lateral side flange of the second pair of lateral side flanges is spaced from one another and extends substantially orthogonally from the second lower lateral flange;

the second lower lateral flange extends continuously between the second pair of lateral side flanges;

each lateral beam of the first pair of lateral beams is attached to one of the lateral side flanges of the first pair of lateral side flanges and is spaced from an opposite one of the lateral side flanges of the first pair of lateral side flanges;

each lateral beam of the second pair of lateral beams is attached to one of the lateral side flanges of the second pair of lateral side flanges and is spaced from an opposite one of the lateral side flanges of the second pair of lateral side flanges; and the opposing ends of the main support beam are coupled with the main side flanges of the first pair of main side flanges and the second pair of main side flanges, respectively.

2. The substructure of claim 1 wherein:

the first lower lateral flange is angled with respect to the first lower main flange by between about 10 degrees and about 20 degrees; and the second lower lateral flange is angled with respect to the second lower main flange by between about 10 degrees and about 20 degrees.

3. The substructure of claim 1 wherein:

each lateral side flange of the first pair of lateral side flanges is angled with respect to respective ones of the main side flanges of the first pair of main side flanges by between about 20 degrees and about 30 degrees; and each lateral side flange of the second pair of lateral side flanges is angled with respect to respective ones of the main side flanges of the second pair of main side flanges by between about 20 degrees and about 30 degrees.

4. The substructure of claim 1 further comprising a ridge cap coupled with the main support beam and overlying the main support beam.

* * * * *